US005570119A

United States Patent [19]

Saito et al.

[11] Patent Number: 5,570,119

[45] Date of Patent: Oct. 29, 1996

[54] MULTILAYER DEVICE HAVING INTEGRAL FUNCTIONAL ELEMENT FOR USE WITH AN INK JET RECORDING APPARATUS, AND RECORDING APPARATUS

[75] Inventors: Asao Saito, Fujisawa; Ryoichi Koizumi; Tsutomu Kato, both of Atsugi, all of Japan

[73] Assignee: Canon Kabushiki Kaisha, Tokyo, Japan

[21] Appl. No.: 347,165

[22] Filed: Nov. 23, 1994

Related U.S. Application Data

[60] Continuation of Ser. No. 928,739, Aug. 13, 1992, abandoned, which is a division of Ser. No. 785,165, Oct. 31, 1991, Pat. No. 5,212,503, which is a continuation of Ser. No. 622,186, Dec. 5, 1990, abandoned, which is a continuation of Ser. No. 382,904, Jul. 21, 1989, abandoned.

[30] Foreign Application Priority Data

Jul. 26, 1988 [JP] Japan ..... 63-184688

[51] Int. Cl.[6] ..... B41J 2/05

[52] U.S. Cl. ..... 347/59; 257/740

[58] Field of Search ..... 347/59; 257/740; 437/195

[56] References Cited

U.S. PATENT DOCUMENTS

| | | | |
|---|---|---|---|
| 3,641,661 | 2/1972 | Canning | 437/195 X |
| 3,949,410 | 4/1976 | Bassous et al. . | |
| 3,984,843 | 10/1976 | Kuhn . | |
| 3,999,210 | 12/1976 | Yamada | 357/23 |
| 4,001,762 | 1/1977 | Aoki et al. | 338/309 |
| 4,291,322 | 9/1981 | Clemens | 257/740 X |
| 4,429,321 | 1/1984 | Matsumoto | 347/59 |
| 4,438,191 | 3/1984 | Cloutier et al. | 347/56 |
| 4,467,345 | 8/1984 | Ozawa | 357/68 |
| 4,532,530 | 7/1985 | Hawkins | 347/62 |
| 4,719,477 | 1/1988 | Hess | 347/59 |
| 4,720,716 | 1/1988 | Ikeda | 346/140 |
| 4,824,803 | 4/1989 | Us | 257/740 X |
| 4,862,197 | 8/1989 | Stoffel | 347/59 |
| 4,914,500 | 4/1990 | Liu | 257/740 X |
| 5,045,870 | 9/1991 | Lamey et al. | 347/59 |
| 5,063,655 | 11/1991 | Lamey et al. | 29/611 |
| 5,157,419 | 10/1992 | Matsumoto | 346/140 |
| 5,212,503 | 5/1993 | Saito | 346/140 R |

FOREIGN PATENT DOCUMENTS

| | | |
|---|---|---|
| 3443560 | 6/1985 | Germany . |
| 3520704 | 12/1985 | Germany . |

OTHER PUBLICATIONS

Askeland, et al. "The Second–Generation Thermal InkJet Structure", Hewlett–Packard Journal, Aug. 1988, pp. 28–31.

Boeller, et al. "High–Volume Microassembly of Color Thermal Inkjet Print–heads and Cartridges", Hewlett–Packard Journal, Aug. 1988, pp. 32–40.

Baker, et al. "Design and Development of a Color Thermal Inkjet Print Cartridge", Hewlett–Packard Journal, Aug. 1988, pp. 6–15.

Erturk, et al. "Ink Retention in a Color Thermal Inkjet Pen", Hewlett–Packard Journal, Aug. 1988, pp. 41–50.

(List continued on next page.)

*Primary Examiner*—Joseph W. Hartary

*Attorney, Agent, or Firm*—Fitzpatrick, Cella, Harper & Scinto

[57] ABSTRACT

A device for use with a liquid jet recording head, and such a head, include a substrate having a semiconductor functional element, an electrothermal transducer electrically connected to the semiconductor functional element for generating thermal energy to be utilized to discharge liquid from the liquid jet recording head, and an insulating layer disposed on the semiconductor functional element and having a contact hole. An electrode is disposed within the contact hole and another insulating layer is disposed on the electrode and has a through hole. The transducer is disposed on the other insulating layer and has a resistor layer and a pair of electrodes, and that resistor layer includes a portion disposed between the electrode within the contact hole and one of the pair of electrodes within the through hole.

11 Claims, 8 Drawing Sheets

OTHER PUBLICATIONS

Palmer, et al. "Ink and Media Development for the HP Paint Jet Printer", Hewlett–Packard Journal, Aug. 1988, pp. 45–50.

Hollis, et al. "Color Thermal Inkjet Printer Electronics", Hewlett–Packard Journal, Aug. 1988, pp. 51–56.

Smith, et al. "Development of a Color Graphics Printer", Hewlett–Packard Journal, Aug. 1988, pp. 16–21.

Cam Ta, et al. "Mechanical Design of a Color Graphics Printer", Hewlett–Packard Journal, Aug. 1988, pp. 21–27.

MULTILAYER DEVICE HAVING INTEGRAL FUNCTIONAL ELEMENT FOR USE WITH AN INK JET RECORDING APPARATUS, AND RECORDING APPARATUS

This application is a continuation of patent application Ser. No. 07/928,735 filed Aug. 13, 1992, now abandoned, which was a division of patent application Ser. No. 07/785,165 filed Oct. 31, 1991, now U.S. Pat. No. 5,212,503, which is a continuation of patent application Ser. No. 07/622,186 filed Dec. 5, 1990, now abandoned, which was a continuation of patent application Ser. No. 07/382,904 filed Jul. 21, 1989, now abandoned.

BACKGROUND OF THE INVENTION

1. Field of the Invention

The present invention relates to a substrate for use with a liquid jet recording head having an electro-thermal transducer and a transducer driving element such as a diode array or a transistor array arranged on one substrate, a liquid jet recording head having such a substrate, and a recorder having such a recording head.

2. Related Background Art

Many principles of discharging liquid have been known in a liquid jet recording method in which liquid is discharged to record data, and various forms of liquid jet recording heads and recorders which utilize such methods have been known.

Among others, a method for discharging liquid by utilizing thermal energy generated by an electro-thermal transducer is suitable for compact, extremely fine and elongated heads, and has been attracting attention.

In a known liquid jet recording head which uses the discharge method which utilizes the thermal energy, an electro-thermal transducer array is formed on a silicon substrate, a transducer driving functional element such as a diode array or a transistor array is arranged externally of the silicon substrate as a drive circuit for the electro-thermal transducer, and the electro-thermal transducer and the functional element are connected by a flexible cable or wire bonding.

In U.S. Pat. No. 4,429,321, a liquid jet recorder having the electro-thermal transducer and the functional element arranged on one substrate has been proposed in order to simplify a structure of the head, reduce trouble encountered during manufacturing process, unify characteristics of elements and improve reproducibility.

Where the method for discharging liquid by utilizing the thermal energy is adopted, a number of electro-thermal transducers are arranged to maximize the advantage thereof so that an elongated and high density head is attained. Where a number of electro-thermal transducers are used, a manner of wiring to the electro-thermal transducers is determined depending on a driving method therefor. In one known method, a common electrode connected in common to the electro-thermal transducers and individual electrodes individually connected to the respective electro-thermal transducers are used. In this method, in order to solve a problem of cross-talk in which one electro-thermal transducer is driven by the drive of another electro-thermal transducer, diodes for preventing the cross-talk are inserted between the respective individual electrodes or the respective electro-thermal transducers and the common electrode. However, since a current of several hundreds of milliamperes to several amperes flows through the common electrode depending on the number of commonly connected diodes, a surface area of the common electrode should be as large as possible. If the surface area is small, a voltage drop occurs due to a wiring resistance. If the voltage drop occurs during the drive of the liquid jet recording head, the discharge velocity of the liquid may be reduced, the diameter of the droplet may be reduced and the reproducibility of the operation may be lowered. This may be one of causes for disabling high grade and high quality recording.

If the surface area is too large and a number of electro-thermal transducers are arranged at a high density, the advantage of compactness which is attained by the use of the thermal energy may not be attained.

Further, the larger the surface area of the electrode is, the larger is the area of the crossing portion of the electrode. The crossing portion of the electrode is normally electrically isolated by an insulative layer except where electrical connection of the crossing electrodes is made. However, in most cases, since a defect such as dust or a pinhole exists in the insulative layer at a certain probability, there may be an area which has an insufficient insulative power. As a result, such an area causes shorting between the electrodes.

When the crossing area is large, a probability of a pinhole is high accordingly, and shorting is more likely to occur.

In order to avoid the above problems, it is preferable that an insulative film without defects be formed, but a total elimination of such defects is hard to attain and increases cost.

If the film thickness of the insulative film (insulative layer) between the electrodes is too thick, it will increase formation time. If it is too thin, the probability of defects of the film will increase. Accordingly, a proper thickness is desired.

SUMMARY OF THE INVENTION

It is an object of the present invention to solve the problems heretofore encountered in a substrate for use with a liquid jet recording head which discharges the liquid by utilizing thermal energy, the liquid jet recording head having such substrate, and a recorder having such recording head.

It is another object of the present invention to provide a substrate for use with a liquid jet recording head which provides a high grade and high quality record, the liquid jet recording head having such a substrate and a recorder having such recording head.

It is another object of the present invention to provide a substrate for use with a liquid jet recording head which prevents shorting from occurring at crosspoints of electrode wirings, a liquid jet recording head having such substrate, and a recorder having such recording head.

It is another object of the present invention to provide a substrate for use with a high performance liquid jet recording head which is of low cost and has no substantial difference in a manufacturing process, a liquid jet recording head having such substrate, and a recorder having such recording head.

An object of this invention is to provide a device for use with a liquid jet recording head, which device includes a substrate having a semiconductor functional element, an electrothermal transducer electrically connected to the semiconductor functional element for generating thermal energy to be utilized to discharge liquid from the liquid jet recording head, and an insulating layer disposed on the semiconductor functional element and having a contact hole. An electrode is disposed within the contact hole and another insulating layer is disposed on the electrode and has a through hole. The transducer is disposed on the other insulating layer and has a resistor layer and a pair of electrodes, and that resistor layer includes a portion disposed between the electrode within the contact hole and one of the pair of electrodes within the through hole.

DETAILED DESCRIPTION OF THE PREFERRED EMBODIMENTS

Figure 1:
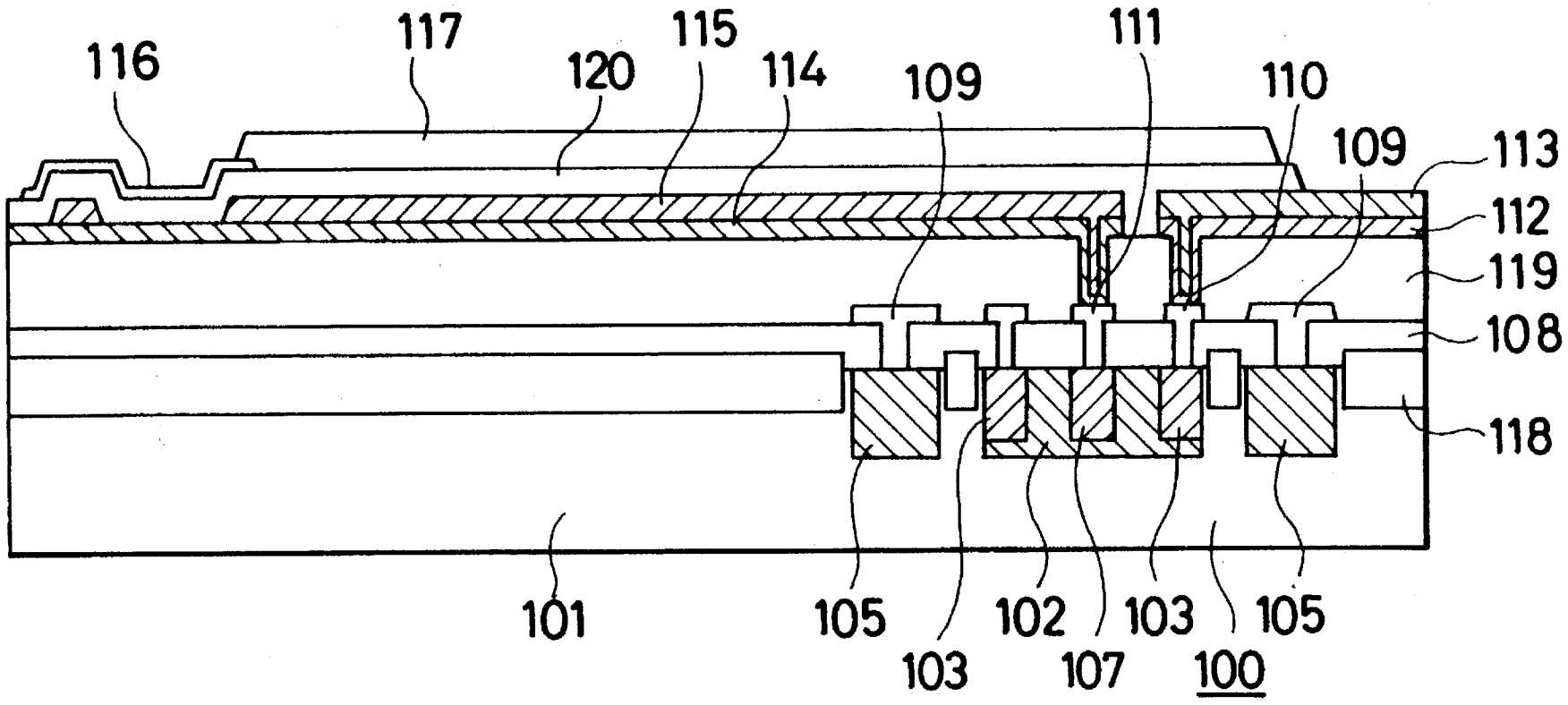
FIG. 1 shows a schematic longitudinal sectional view of a substrate for use with a liquid jet recording head.

FIG. 1 shows a schematic longitudinal sectional view of a substrate for a liquid jet recording head having electro-thermal transducers formed on an N type silicon substrate on which diodes 100 are formed as functional elements. A P-well diffusion layer 102 is formed in a portion of the N type silicon substrate 101. A $P^+$ layer 103 electrically connected to an anode electrode 110 of the diode is formed around the P well layer 102. $N^+$ layers 107 and 105 having a cathode 111 of the diode and a cap electrode 109 for restricting a parasitic transistor operation between diodes electrically connected thereto, respectively are also formed in the silicon substrate.

A top of the diode structure is covered with an insulative layer 108, aluminum wirings 113 and 115 are electrically connected to the electrodes 110 and 111, and resistor layers 112 and 114 are electrically connected to the electrodes 110 and 111 through the aluminum wirings 113 and 115.

The aluminum electrode 109 on the $N^+$ layer for the cap electrode is wired to surround the diode as the $N^+$ layer 105 does, and a cap potential is externally applied thereto through a lead wire (not shown). The diode is formed between the anode electrode 110 and the cathode electrode 111, and the anode electrode 110 is extended to an external terminal of the liquid jet recording head through the resistor wiring 112 and the aluminum wiring 113.

The anode electrode 110 is connected to a common electrode to which a plurality of anode electrodes are normally connected, depending on a drive system.

The common electrode has a surface area which allows a current determined by the number of electro-thermal transducers connected to the common electrode (the number of anodes) to flow without a substantial voltage drop.

Figure 2:
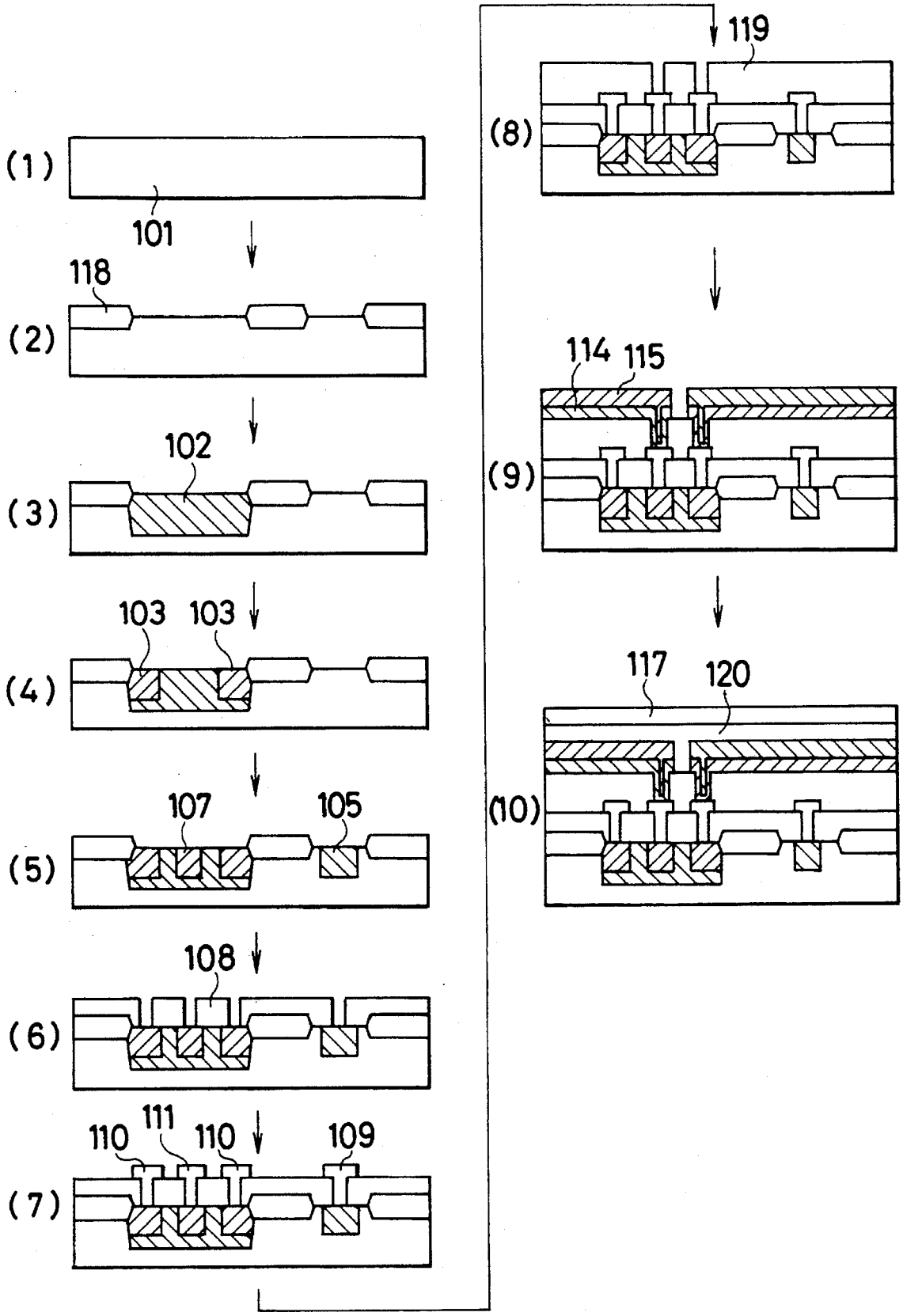
FIG. 2 shows a schematic sectional view for illustrating a manufacturing process for forming functional elements on a substrate.

FIG. 2 shows schematic sectional views which illustrate a process to manufacture the functional element shown in FIG. 1. It shows only a portion of the recording head substrate shown in FIG. 1.

In a step (2), an $SiO_2$ insulative layer 118 is coated on the N type silicon substrate 101 and it is patterned. In a step (3), a P type impurity (conductivity type determining material) is doped in a desired area of the silicon substrate 101 to form the P well diffusion layer 102. In steps (4) and (5), the $P^+$ layer 103 and the $N^+$ layer 107 are formed in the P well layer 102. The $N^+$ layer 105 for the cap electrode is formed adjacently to the P well layer 102. In a step (6), the inorganic oxide $SiO_2$ insulative layer 108 is coated on the semiconductor structure and it is patterned. In steps (7) and (8), the anode electrode 110, the cathode electrode 111 and the cap electrode 109 are formed in the patterned area of the $SiO_2$ layer, and the inorganic oxide $SiO_2$ insulative layer 119 is coated thereon. The $SiO_2$ insulative layer 119 functions as the insulative layer for the diode as well as a heat accumulation layer arranged under the electro-thermal transducer.

In steps (9) and (10), the resistor wirings 112 and 114 and the aluminum wirings 113 and 115 which are formed as the heat generating resistor layers and the wiring terminals of the common electrode and the electro-thermal transducer are connected to the anode electrode 110 and the cathode electrode 111 of the diode, respectively, and the $SiO_2$ insulative layers 117 and 120 are formed thereon.

Figure 3A:
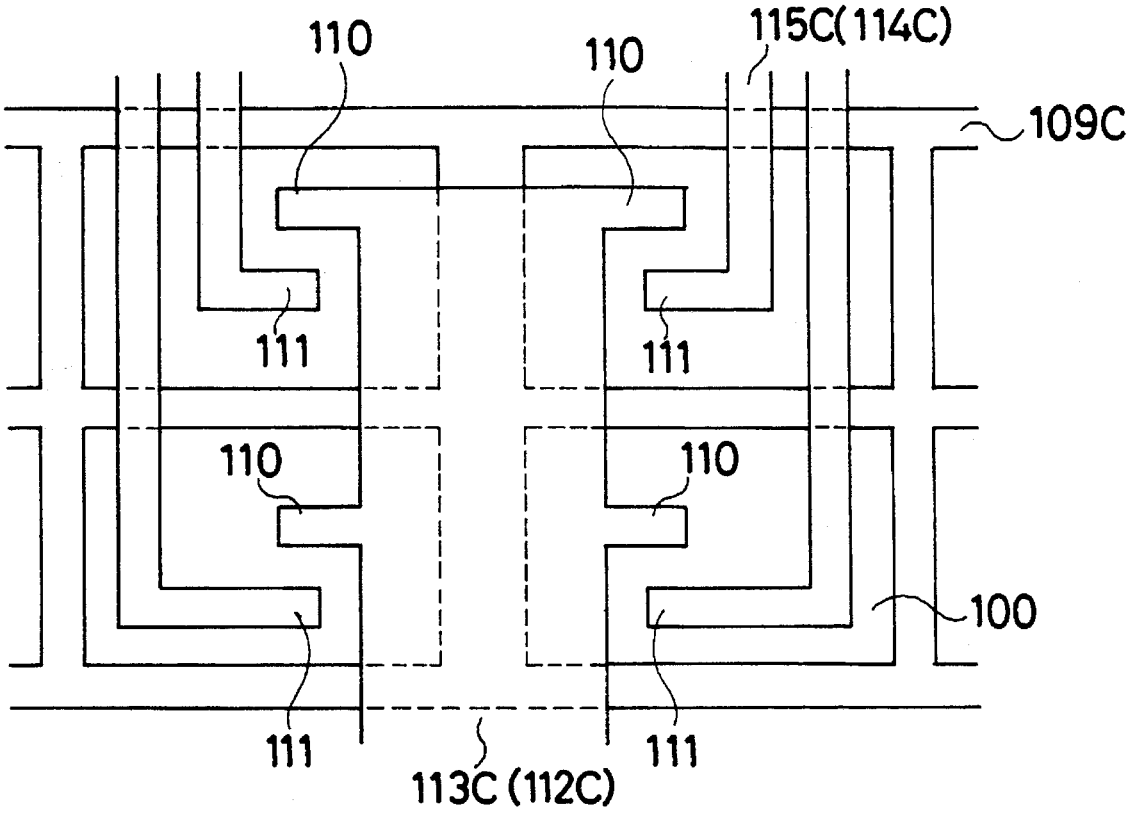
FIGS. 3(A) and 3(B) show top views for illustrating electrode wiring patterns of a substrate.
Figure 3B:
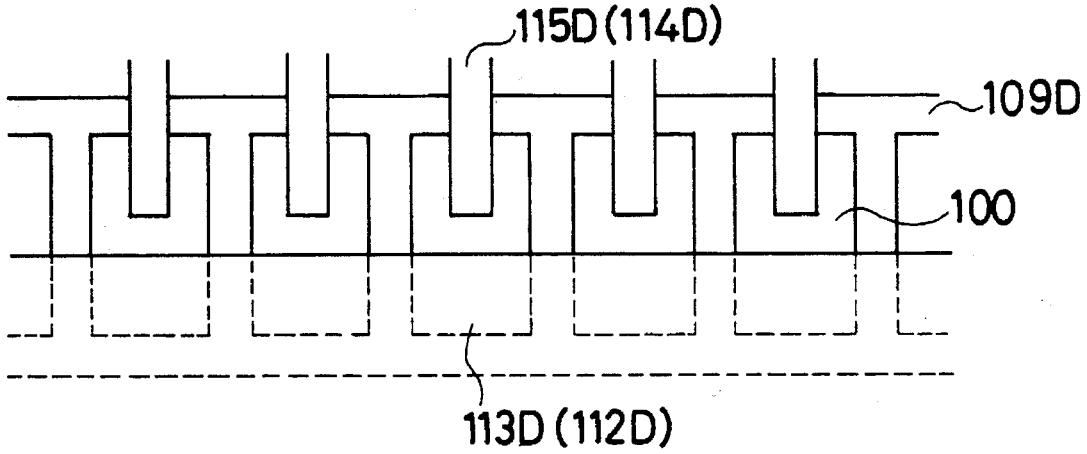

In this manner, the electro-thermal transducers are formed on the silicon wafer on which the diodes are formed as the functional elements. FIGS. 3(A) and 3(B) show plan views which illustrate a relationship between the cap electrodes and the common electrode.

FIG. 3(A) shows a 2×2 diode matrix and FIG. 3(B) shows a 1×5 diode matrix. It is seen that the common electrodes 113C and 113D to which a plurality of anode electrodes are connected and the wirings 115C and 115D which form parts of the electro-thermal transducer connected to the anode electrode 111 cross the cap electrodes 109C and 109D. Since relatively large currents flow through the common electrodes 113C and 113D, as stated above, they should be of large area and hence the crossing areas increase.

The electrodes are basically isolated by the $SiO_2$ insulative layers but the increase of the crossing areas may cause the problems described above. In the present invention, those problems are solved by a structure which will be described below.

Figure 4A:
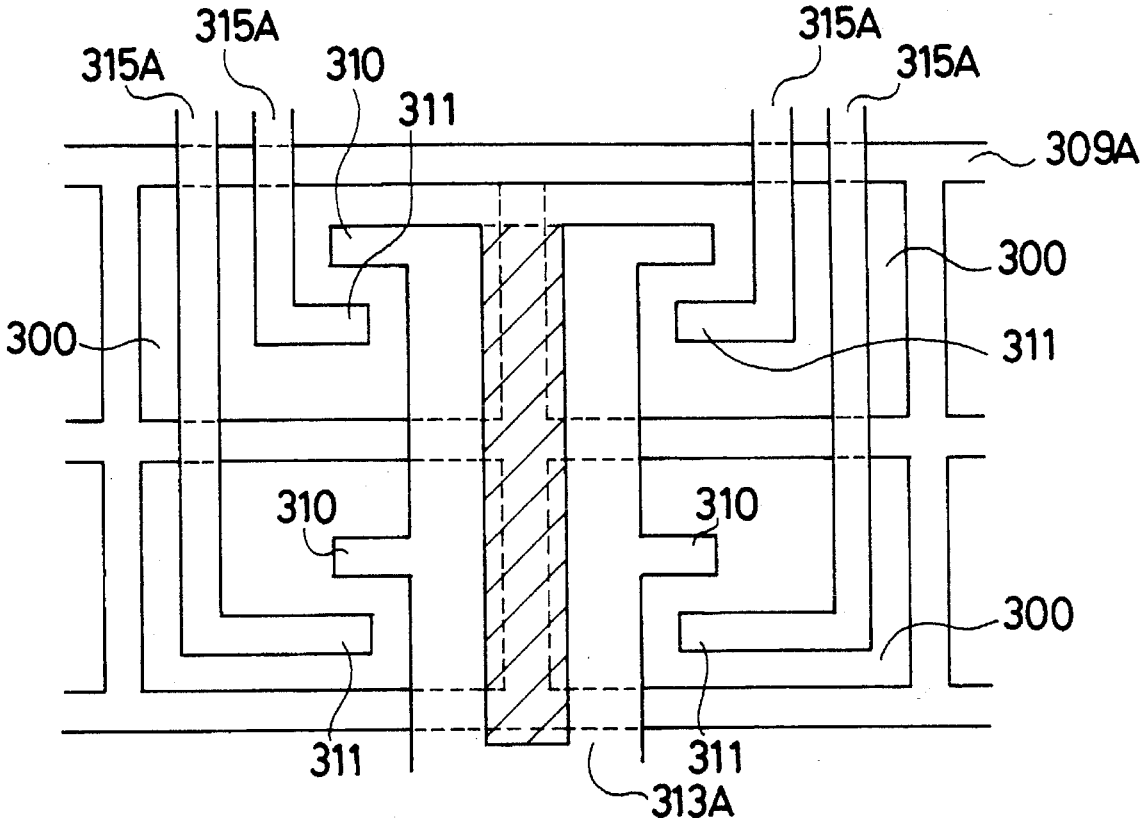
FIGS. 4(A) and 4(B) show top views for illustrating electrode wiring patterns of a substrate of the present invention.

FIG. 4(A) is a top view of a wiring pattern of a diode matrix in a substrate for a liquid jet recording head, in accordance with one embodiment of the present invention. It shows a matrix having a plurality of cells of diodes shown in FIG. 1 arranged therein.

Numerals 310 and 311 denote an anode electrode and a cathode electrode arranged for each diode cell. Numeral 315A denotes an aluminum wiring for connecting an electro-thermal transducer with a cathode electrode 311, numeral 309A denotes a cap electrode formed to surround the diode cell 300, and numeral 313A denotes a common electrode made of aluminum to which four anode electrodes 310 are connected.

The common electrode 313A and the aluminum wiring 315A cross the cap electrode 309A as they do in the previous structure. However, a notch (hatched area) is formed in the crossing area of the common electrode 313A and the cap electrode 309A so that the crossing area of the common electrode 313A and the cap electrode 309A is minimized and the shorting between the electrodes due to insufficient insulation is minimized.

The above structure can be attained by simply changing the pattern on the mask. Thus, a defect rate in the manufacturing process can be reduced without complex manufacturing process or any measure for dust.

Figure 4B:
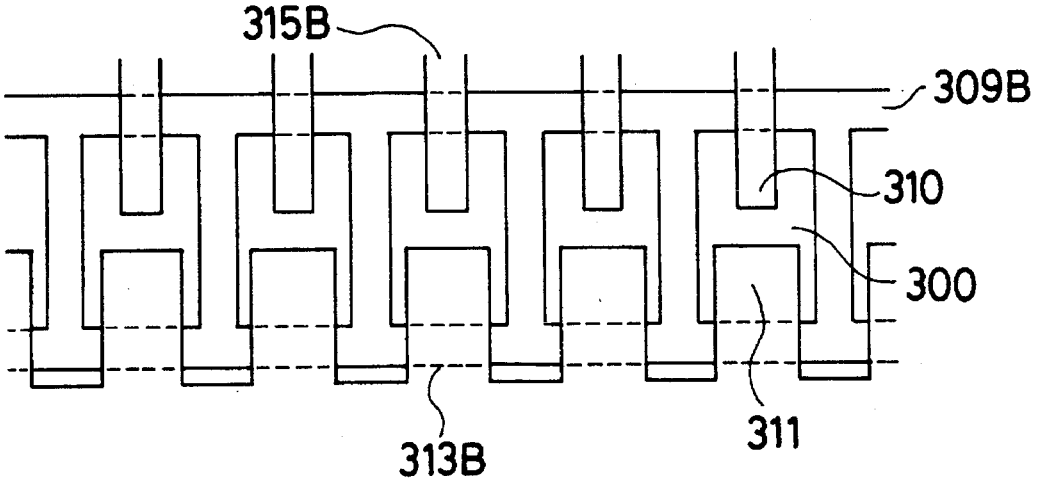

FIG. 4(B) shows a top view of a wiring pattern in a linear diode array in another embodiment of the present invention. As seen from FIG. 4(B), the common electrode 313B has a notch formed at the crossing area to the cap electrode 309B so that the crossing area of the electrodes is reduced and a risk of the shorting due to a pinhole in the insulative film is avoided.

In the embodiments shown in FIGS. 4(A) and 4(B), the diode matrices formed on the N type substrates are used. Where the diodes are formed on a P type silicon substrate, the risk of the shorting can be significantly reduced by minimizing the crossing area of the common electrode and the cap electrode for isolating the diode cells.

Figure 5A:
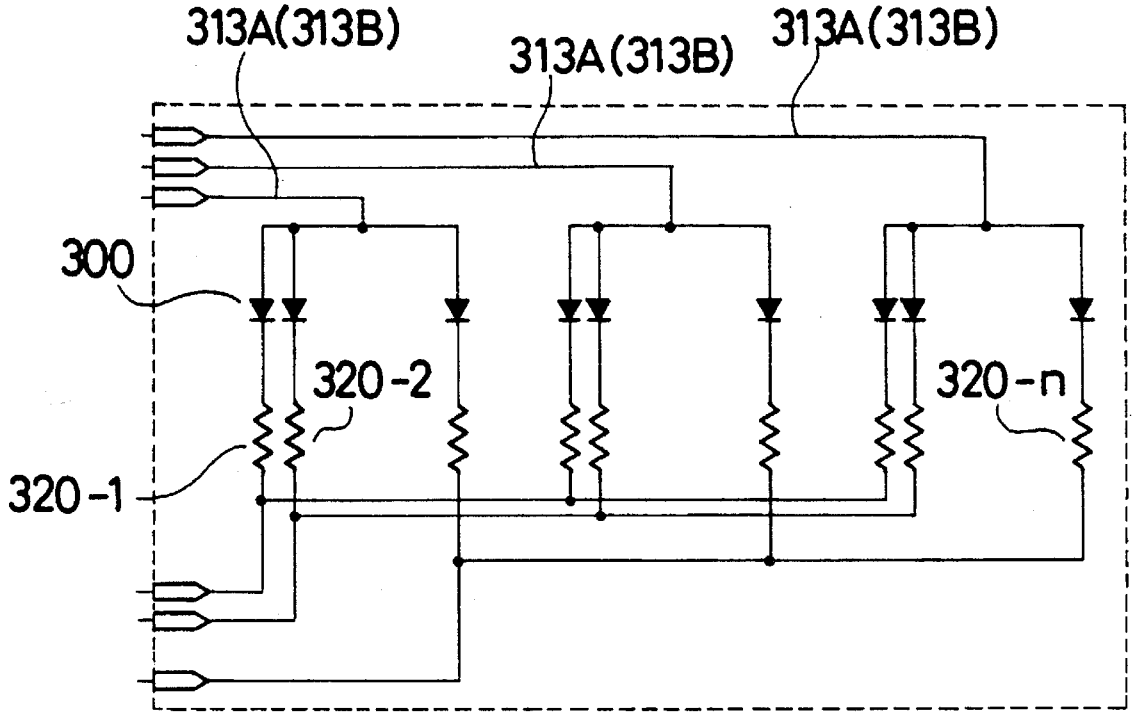
FIGS. 5(A)–5(C) show equivalent circuits for illustrating circuits of the substrate of the present invention.

FIG. 5(A) shows an equivalent circuit of the liquid jet recording head which incorporates the diode matrix array shown in FIG. 4(A) or 4(B) and electro-thermal transducers 320-1 to 320-n. The on/off control to the electro-thermal transducers 320-1 to 320-n is effected by transistors (not shown) provided one for each of the terminals.

Figure 5B:
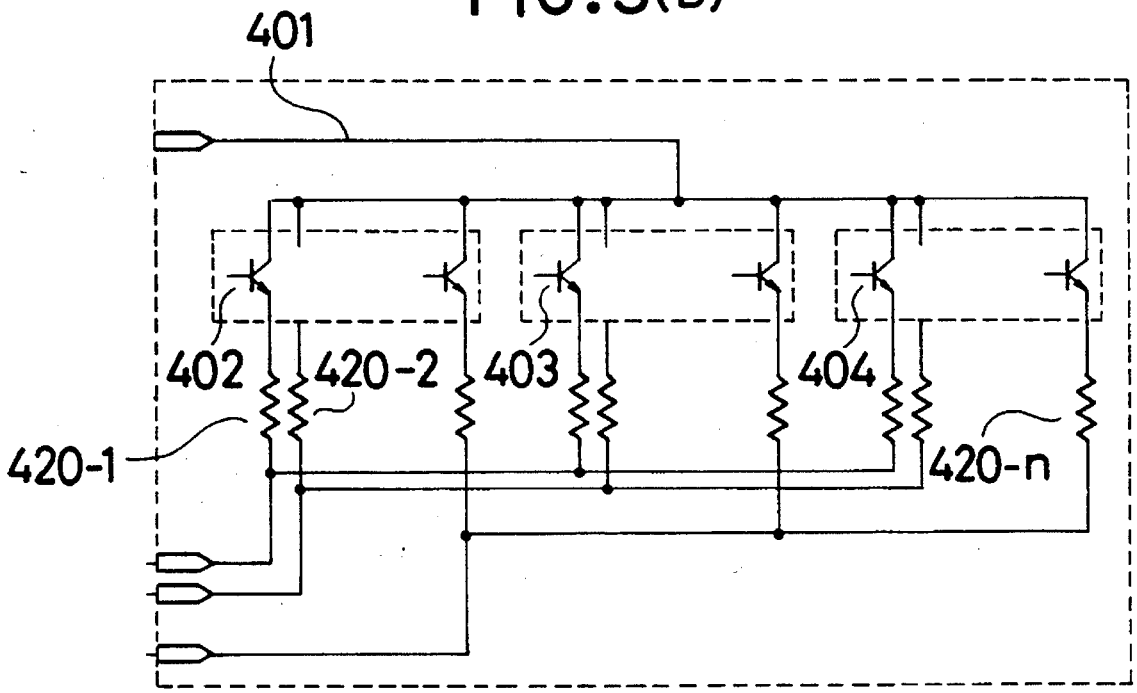

The diode array on the N type silicon substrate may be changed to an $N^+$ layer or $P^+$ layer structure by changing the mask pattern to form an NPN type transistor array shown in FIG. 5(B). In this case, since the common electrode 401 carries a large current, it is of large area and a crossing area to the base electrodes 402, 403 and 404 of the NPN transistors which turn on and off the block increases. Accordingly, the crossing area is structured in the same manner as that described above so that the probability of the shorting by the pinholes of the insulative film is reduced.

The structure may be replaced by a PNP transistor array to attain the same effect.

Figure 5C:
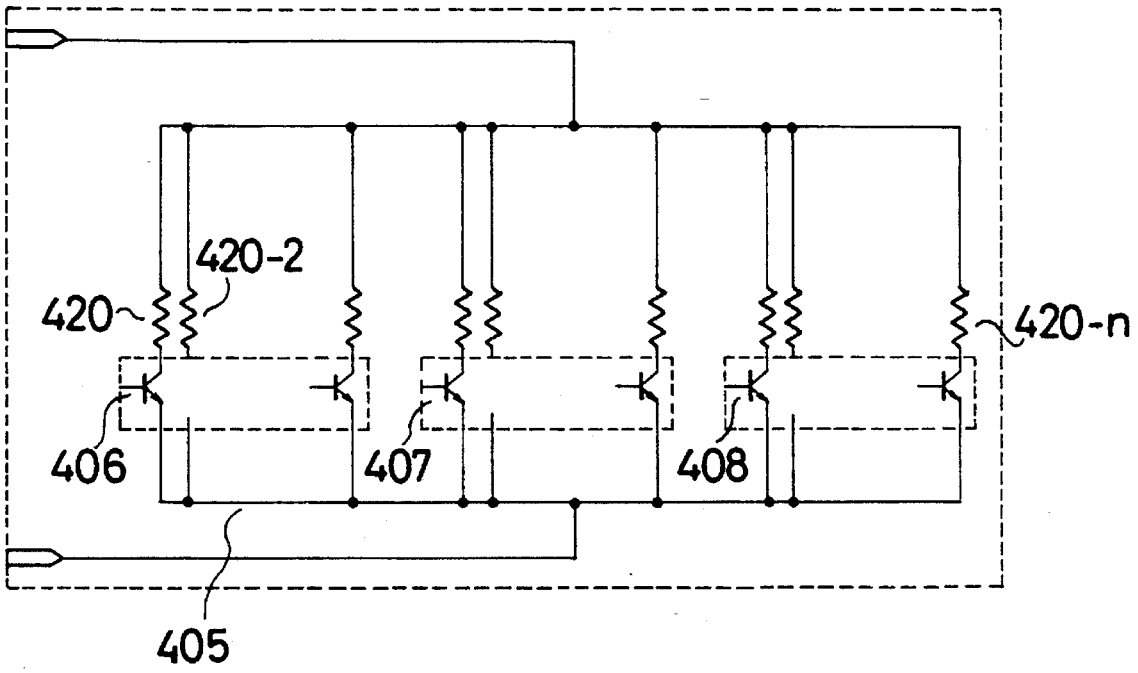

FIG. 5(C) shows an equivalent circuit diagram where a transistor array is arranged on the opposite side (ground side) of electro-thermal transducers 420-1 to 420-n. In this case, emitter electrodes 405 of the NPN type transistor array are connected to a common ground line which must be of large area in order to permit the flow of a large current. Thus, a crossing area to the base electrodes 406, 407 and 408 of the NPN type transistor array which turns on and off the block is structured in the same manner as that described above so that the probability of the shorting between electrodes is significantly reduced.

Figure 6:
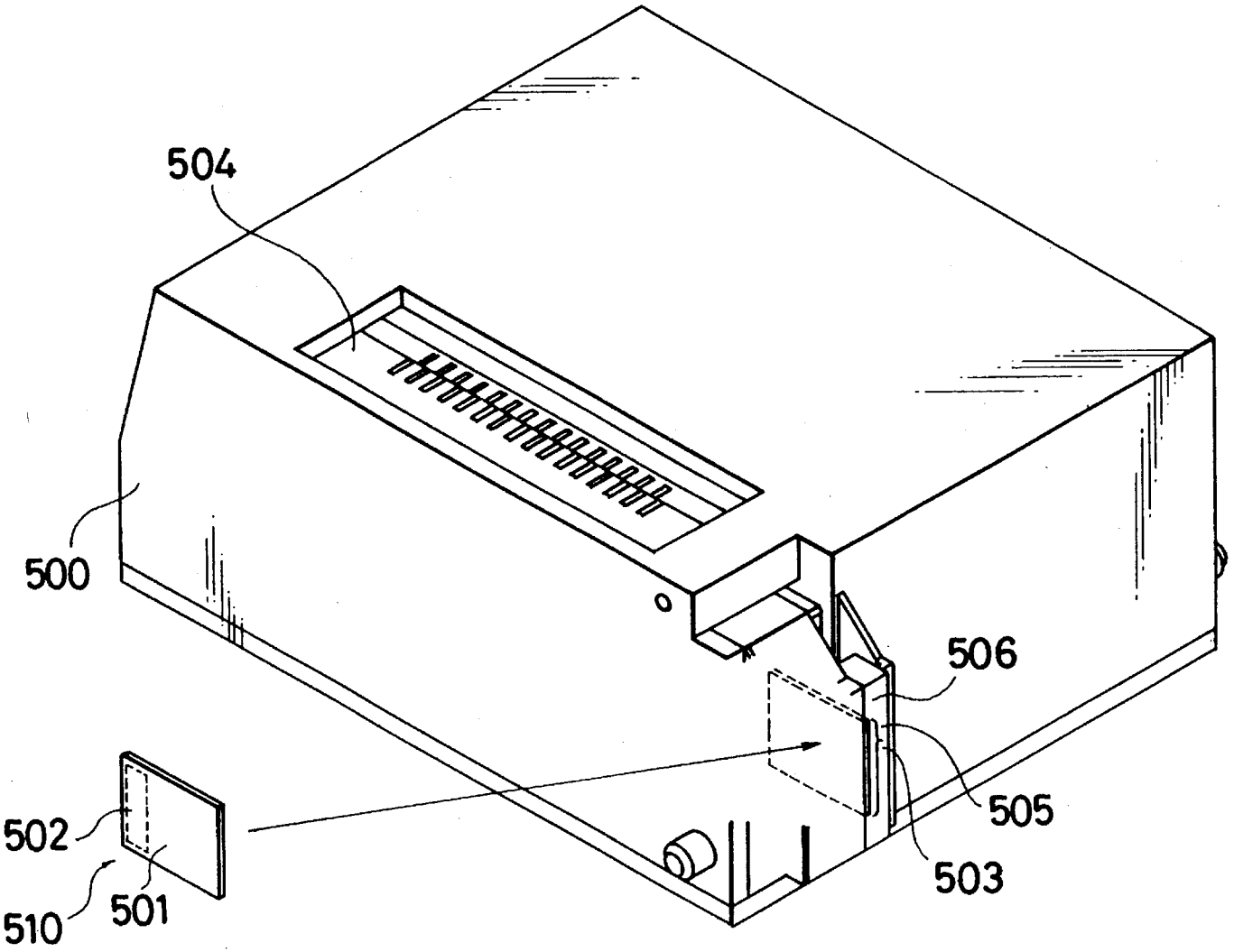
FIG. 6 shows a perspective view of a recording head cartridge having the recording head which has the substrate of the present invention.

FIG. 6 shows a perspective view of a recording head cartridge having a diode array or transistor array which serves as a functional element and electro-thermal transducers patterned thereon.

Numeral 500 denotes a liquid jet recording head cartridge, which is preferably used in a serial type liquid jet recorder. The top of the head cartridge 500 is a junction surface to the carriage, and numeral 504 denotes an input terminal for receiving a control signal to connect it to a terminal of the cartridge.

The head cartridge 500 also has an ink tank for storing liquid (ink) to be supplied to the recording head. Thus, the head cartridge 500 may be disposable so that when the ink in the ink tank has been exhausted, the cartridge is removed from the carriage of the recorder and a new cartridge is loaded in the recorder.

An embodiment of the recorder which incorporates the liquid jet recording head cartridge is now explained with reference to FIG. 7.

Figure 7:
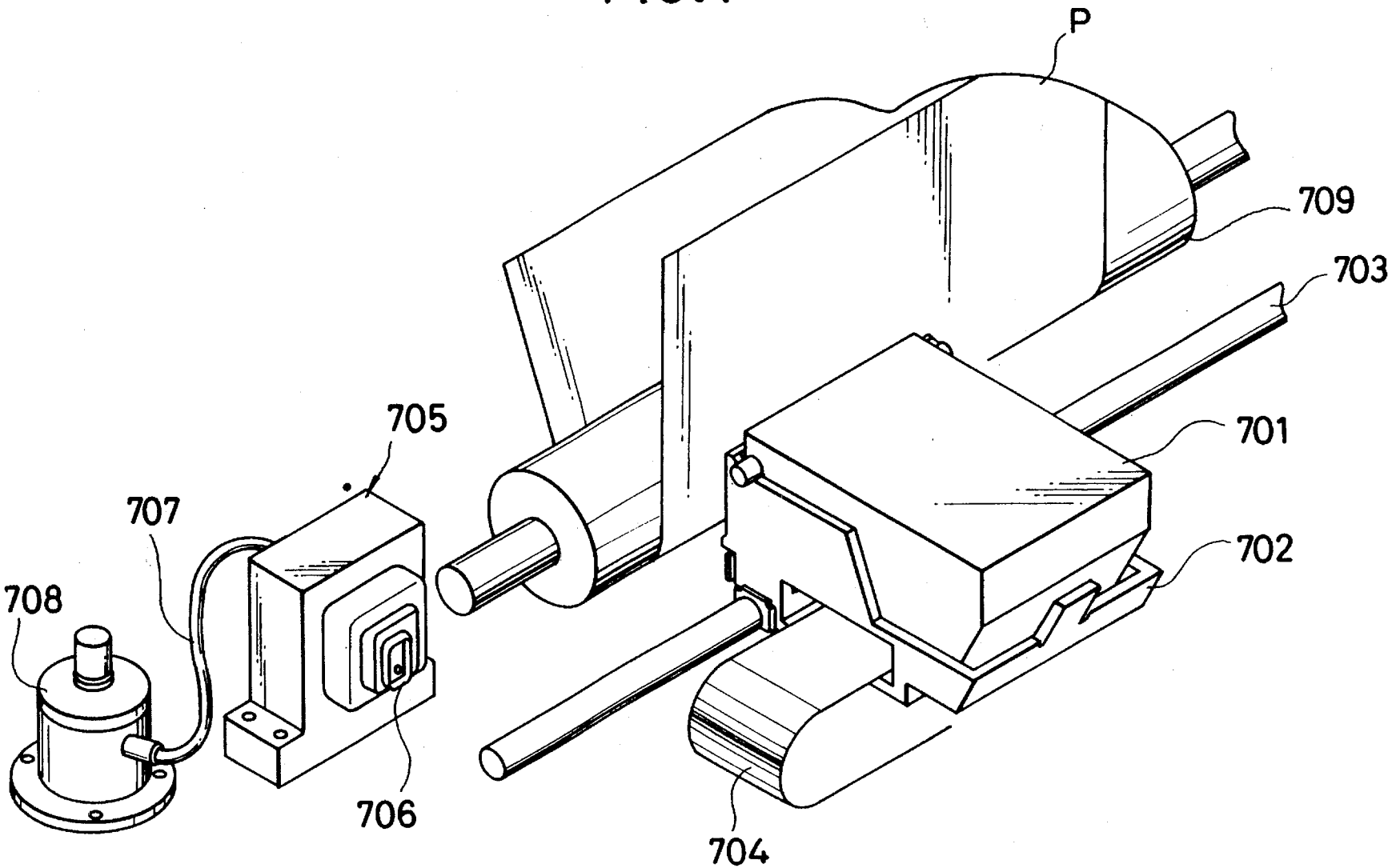
FIG. 7 shows a perspective view for illustrating a main portion of a recorder having the recording head cartridge shown in FIG. 6.

In FIG. 7, numeral 701 denotes a head cartridge, numeral 702 denotes a carriage, numeral 703 denotes a rail, numeral 704 denotes a flexible wiring board, numeral 705 denotes a capping device, numeral 706 denotes a cap, numeral 707 denotes a suction tube, numeral 708 denotes a suction pump, numeral 709 denotes a platen and P denotes a record sheet as a record medium.

The head cartridge 701 is mounted on the carriage 702 so that it is electrically connected and positioned. The carriage 702 is reciprocally moved by drive means (not shown) along the rail 703 and along the platen 709 along which the record sheet is fed. A drive signal from the recorder is supplied through the flexible wiring board to the electrical contact (not shown) of the carriage 702.

The capping means 705 has the cap 706. When the head cartridge reaches the capping position as the carriage 702 moves, the cap 706 covers the discharge port of the head cartridge (capping). Under this condition (capping state), when the suction pump 708 is driven, ink is sucked from the discharge port of the head cartridge through the suction tube 707 so that the function of the head cartridge is restored and/or retained.

Instead of the head cartridge structure having the ink tank as shown in FIGS. 6 and 7, the recording head may be fixed to the carriage 702 and the ink may be supplied from the ink tank mounted on the recorder through an ink supply tube. Many modifications of the present embodiment may be made without departing from the present invention.

While the capping device is used for the suction mechanism in the above embodiment, other constructions may be used so that the maintenance of the head function and the recovery of the discharge function are measured. In some cases, the capping device itself may be omitted. However, the capping device is preferable to attain more positive recording.

In accordance with the present invention, a probability of the shorting between electrodes due to defects such as dust on the insulative layer can be reduced.

As a result, the trouble caused by the shorting between the electrodes of the functional element can be reduced without any special insulative layer forming process and by a conventional inexpensive forming process.

In accordance with the present invention, the substrate for use with the liquid jet recording head which solves the above problems and achieves the above objects, the liquid jet recording head having such substrate and the recorder having such recording head are provided.

We claim:

1. A device for use with a liquid jet recording head, comprising:

a substrate comprising a semiconductor functional element;

an electrothermal transducer electrically connected to said semiconductor functional element for generating thermal energy to be utilized to discharge a liquid from said liquid jet recording head;

an insulating layer disposed on said semiconductor functional element and having a contact hole;

an electrode disposed within said contact hole; and another insulating layer disposed on said electrode and having a through hole, wherein said transducer is disposed on said another insulating layer and has a resistor layer and a pair of electrodes, and said resistor layer includes a portion disposed between said electrode within said contact hole and one of said pair of electrodes within said through hole.

2. A device according to claim 1, wherein said electrothermal transducer is formed on said substrate, and said substrate is a semiconductor substrate.

3. A device according to claim 1, wherein said semiconductor functional element comprises a diode.

4. A device according to claim 1, wherein said semiconductor functional element comprises a transistor.

5. A device according to claim 1, wherein said electrothermal transducer is formed on said substrate, and said substrate is a semiconductor substrate, said semiconductor substrate comprising an intervening protective layer for said semiconductor functional element.

6. A device according to claim 5, wherein said protective layer comprises an inorganic oxide.

7. A device according to claim 6, wherein said inorganic oxide comprises $SiO_2$.

8. A device according to claim 1, wherein said transducer has a heating section arranged on an upper section of said substrate on which said functional element is not arranged.

9. An ink jet recording apparatus comprising:

a device for use with said liquid jet recording head, comprising, a substrate comprising a semiconductor functional element;

an electrothermal transducer electrically connected to said functional element for generating thermal energy to be utilized to discharge a liquid from said liquid jet recording head;

an insulating layer disposed on said functional element and having a contact hole;

an electrode disposed within said contact hole; and another insulating layer disposed on said electrode and having a through hole, wherein said transducer is disposed on said another insulating layer and has a resistor layer and a pair of electrodes, and said resistor layer includes a portion disposed between said electrode within said contact hole and one of said pair of electrodes within said through hole.

10. An apparatus according to claim 9, further comprising a carriage for conveying said device.

11. An apparatus according to claim 9, further comprising a conveying roller for conveying a recording medium.

* * * * *

UNITED STATES PATENT AND TRADEMARK OFFICE

CERTIFICATE OF CORRECTION

PATENT NO. : 5,570,119

DATED : October 29, 1996

INVENTOR(S) : ASAO SAITO ET AL.

It is certified that error appears in the above-indentified patent and that said Letters Patent is hereby corrected as shown below:

On Title page, Item [54] and col. 1, lines 1-4,
"MULTILAYER DEVICE HAVING INTEGRAL FUNCTIONAL ELEMENT FOR USE WITH AN INK JET RECORDING APPARATUS, AND RECORDING APPARATUS" should read
--SUBSTRATE FOR USE WITH A LIQUID JET RECORDING HEAD, A LIQUID JET RECORDING HEAD HAVING SUCH A SUBSTRATE, AND A RECORDER HAVING SUCH A RECORDING HEAD--.

Col. 1, Line 7, "Ser. No. 07/928,735" should read --Ser. No. 07/928,739--.

Col. 7, Line 24, "comprising," should read --comprising:--.

Signed and Sealed this

Twentieth Day of May, 1997

*Attest:*

*Attesting Officer*

Bruce Lehman

BRUCE LEHMAN

*Commissioner of Patents and Trademarks*